(Prior art)

(Prior art)

REFRIGERANT APPARATUS

FIELD OF THE INVENTION

The present invention relates to a refrigerant apparatus having a compressor, a condenser, a first expansion valve means, a gas-liquid separator, a second expansion valve and an evaporator. The compressor of the present invention has a plurality of compression chambers, one part of which is connected with the portion of the gas-liquid separator, the other portions of which are connected with the evaporator so that the cooling capacity of the liquid coolant within the gas-liquid separator is increased.

BACKGROUND OF THE INVENTION

A refrigerant apparatus which has an injection passage through which the gas coolant within the gas-liquid separator is injected into the compressor has been known as a so-called gas injection type refrigerant apparatus. FIG. 10 shows one type of such a conventional gas injection type refrigerant apparatus. The compressor 400 used for this type of refrigerant apparatus is a rotary type compressor which has a compression chamber, the effective volume of which is varied according with the rotation of the rotor. However, since both the coolant within the gas portion of the gas liquid separator 5 and the coolant within the evaporator 8 are introduced into the same compression chamber of the compressor 400, it is very hard to work the compressor 400 effectively. Therefore, the refrigerant apparatus shown in FIG. 10 is deemed to be impossible to work effectively.

In order to suck the gas coolant within the gas-liquid separator effectively, the refrigerant apparatus shown in FIG. 11 has also been used. Such an apparatus as shown in FIG. 11 has a main compressor 400 to which the coolant within the evaporator 8 is introduced and a sub-compressor 200 to which the coolant within the gas fuel separator 5 is introduced. The refrigerant apparatus shown in FIG. 11, however, has a serious disadvantage in that the sub-compressor 200 requires an extra lubricant system. The main compressor 400 used for the refrigerant apparatus is lubricated by the lubricant which is introduced into the compressor with the coolant. On the other hand, since the sub-compressor 200 is connected with the gas portion of the gas-liquid separator, the lubricant within the refrigerant apparatus is very hard to introduce into the sub-compressor 200. Therefore, the sub-compressor 200 requires an extra lubricating system in order to lubricate itself.

OBJECT AND SUMMARY OF THE INVENTION

An object of the present invention is to provide a refrigerant apparatus which has a single compressor to which the gas coolant from the gas-liquid separator is injected. Another object of the present invention is to provide a refrigerant apparatus having a compressor which sucks the coolant from both the evaporator and the gas liquid separator effectively. A further object of the present invention is to provide a refrigerant apparatus having a compressor which is lubricated by the lubricant within the refrigerant apparatus, namely the lubricant which is introduced into the compressor with the coolant.

In order to attain these objects, the refrigerant apparatus of the present invention employs a compressor having a plurality of compression chambers, a condenser, a first expansion valve means, a gas-liquid separator, a second expansion valve means and an evaporator. The gas coolant within the gas-liquid separator is injected into one part of the compression chamber of the compressor. The coolant from the evaporator is introduced into the other portions of the compression chamber of the compressor. Both the coolant injected into one part of the compression chamber and the coolant introduced into another part of the compression chamber is then compressed to discharge toward the condenser. Since the lubricant is introduced into the compressor mainly with the coolant from the evaporator, the compressor of the present invention can be lubricated effectively. Also, since the compressor of the present invention has two types of suction ports, one of which is connected with the gas-liquid separator through an injection passage, and another one which is connected with the evaporator, the compressor can suck the coolant and compress it effectively.

DETAILED DESCRIPTION OF THE PREFERRED EMBODIMENT

Figure 1:
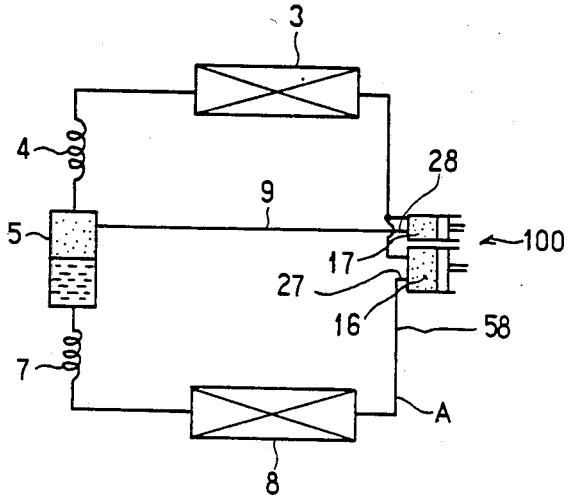
FIG. 1 shows a first embodiment of the refrigerant apparatus according to present invention.
Figure 2:
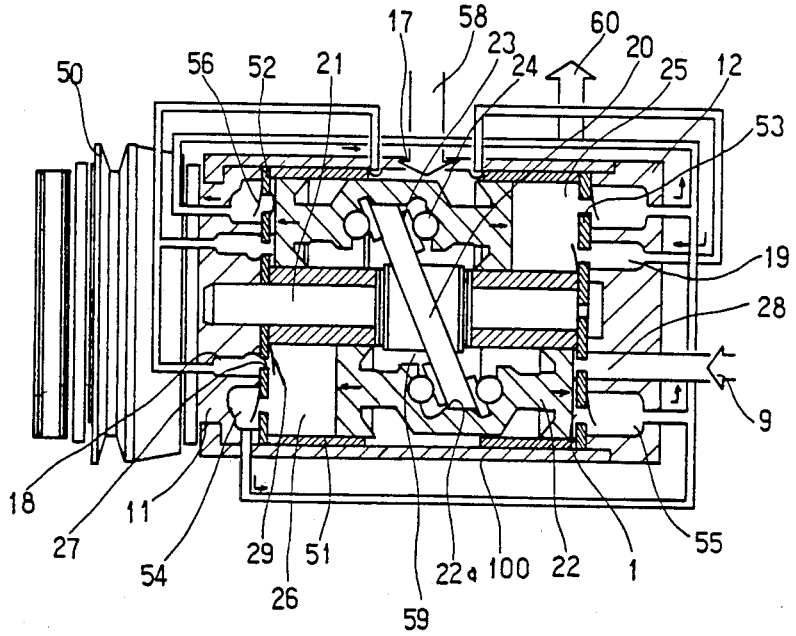
FIG. 2 is a sectional view showing a compressor used for the apparatus shown in FIG. 1.
Figure 3:
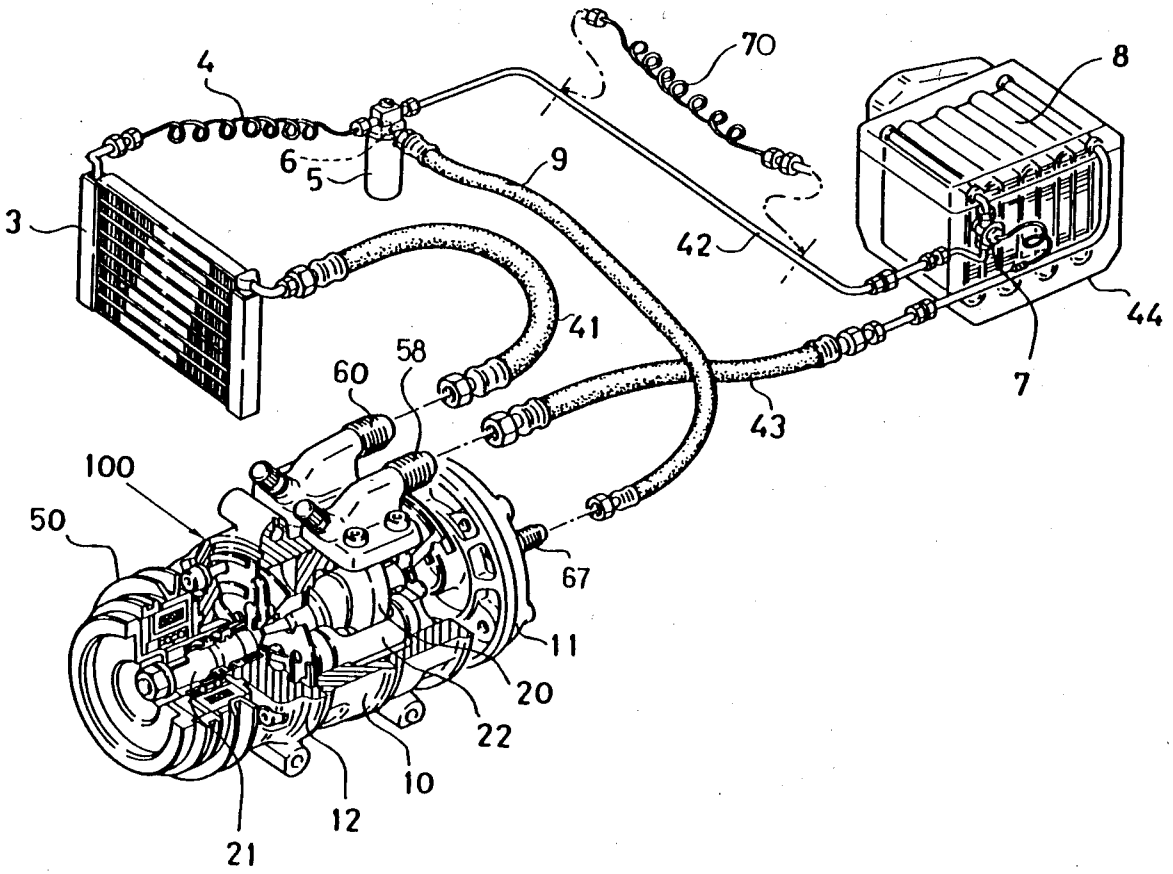
FIG. 3 is a perspective view showing the apparatus shown in FIG. 1.
Figure 4:
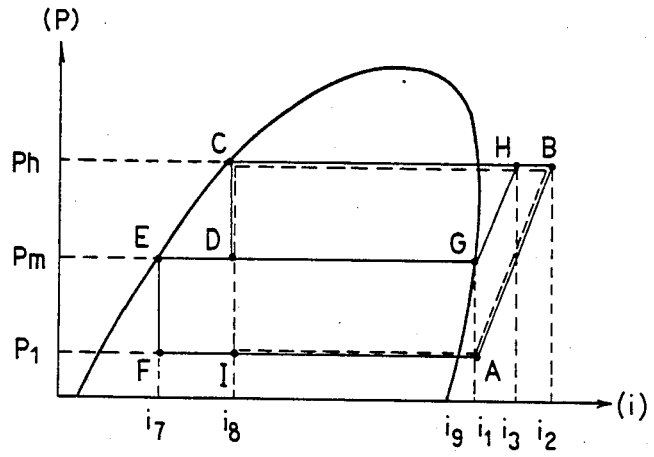
FIG. 4 is a mollier diagram explaining the operation of the apparatus shown in FIG. 1.
Figure 5:
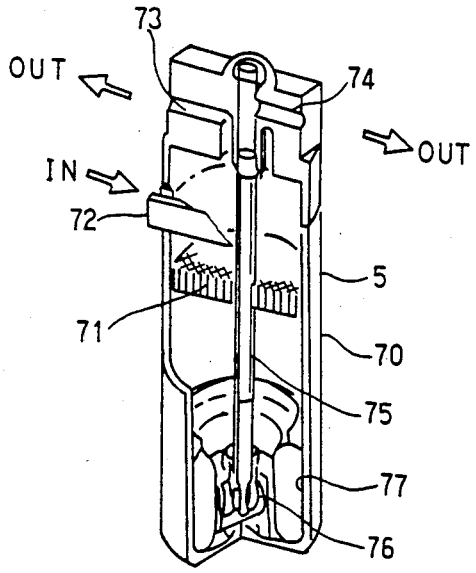
FIG. 5 is a perspective view of the gas liquid separator used in the apparatus shown in FIG. 1.

The preferred embodiment of the present invention is described hereinafter:

In FIG. 1, numeral 100 shows a compressor having a plurality of the cylinders 16 and 17, and a single discharge port. Numeral 3 shows a condenser to which the pressurized coolant compressed in the compressor 100 is introduced. The coolant introduced into the condenser 3 is cooled in order to be condensed. Numeral 4 shows a first expansion valve means, the refrigerant apparatus of the present invention using a capillary tube as the first expansion valve. The condensed coolant condensed in the condenser 3 is introduced into the first expansion valve 4 so that the pressure of the coolant is reduced when the coolant passes through the first expansion valve 4. Numeral 5 shows a gas-liquid separator to which the coolant expanded by the first expansion valve 4 is introduced. The coolant is separated into a gas phase and liquid phase. Gas coolant within the gas-liquid separator 5 is sucked through injection passage 9 toward the cylinder 17 of the compressor 100, wherein

TABLE 1

| | Present invention | Comparative apparatus |
|---|---|---|
| amount of coolant passing through evaporator | $Ge = k \cdot r_1 \cdot Vc$ | $Ge' = k \cdot r_1(Vc + Vc')$ |
| amount of coolant passing through condenser | $Gc = k(r_1 \cdot Vc + r_9 \cdot Vc')$ | $Gc' = k \cdot r_1(Vc + Vc')$ |
| cooling capacity | $Qe = Ge(i_1 - i_7)$ | $Qe' = Ge'(i_1 - i_8)$ |
| load of compressor | $L = Ge(i_2 - i_1) + (Gc - Ge)(i_3 - i_9)$ | $L' = Ge'(i_2 - i_1)$ |
| effective coefficiency | $E = \frac{Qe}{L}$ | $E' = \frac{Qe'}{L'}$ |

where r1 is the specific weight (kg/m$^3$) of the coolant at point A; r9 is the specific weight of the coolant at point G; $V_c$ is the volume (cc) of the cylinder 16; $V_c'$ is the volume of the cylinder 16; i is the enthalpy (kcal/kg) of the coolant at the point A–I; and K is a coefficient calculated by the equation $K = Nc \cdot \eta V \cdot 60 \cdot 10^{-6} \cdot Nc$, where Nc is the rotation (rpm) of the compressor, and $\eta V$ is the volumetric efficiency of the compressor.

According to the calculation using the equations shown in Table 1, the refrigerant apparatus of the present invention has 17% extra capacity with respect to the comparative apparatus when Freon-12 is used as the coolant, the pressure PH of the compressor being set as 15 kg/cm$^2$·G and the discharge suction pressure PL of the compressor being set as 2 kg/cm$^2$×G. Both the apparatus of the present invention and the comparative apparatus have the compressor having ten cylinders, and 9 cylinders of the compressor of the present invention is connected with the evaporator 8, whereas the remaining one cylinder is connected with the gas-liquid separator 5 via injection passage 9.

As described above, the capacity of the refrigerant of the apparatus of the present invention is calculated by the difference of the enthalpy of the coolant between the upstream and downstream sides of the evaporator 8. Since the difference of the present invention $I_1$–$I_7$ is larger than that of the comparative apparatus $I_1$–$I_8$, the apparatus of the present invention can work more effectively even though the volume of the coolant passing through the evaporator 8 is reduced. Also, since the compressor 100 of the present invention can compress both coolant coming from the evaporator 8 and from the gas-liquid separator 5, the compressor 100 can be lubricated by the lubricant within the coolant from the evaporator 8 so that the compressor 100 can work very effectively. Furthermore, since the enthalpy $I_3$ of the coolant in the discharge chamber 55 is smaller than that in the discharge chamber 54, the coolant within the discharge chamber 54 is cooled by the coolant within the discharge chamber 55 so that the temperature of the coolant within the conduit 41 can be reduced.

Figure 6:
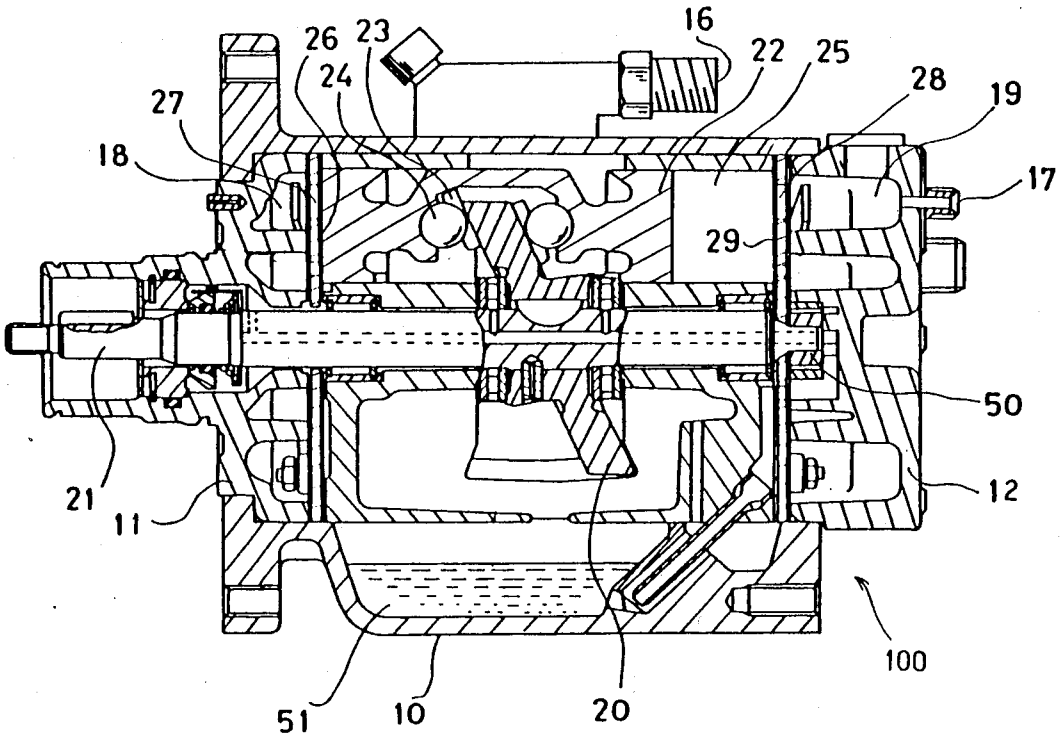
FIG. 6 is a sectional view of the compressor used for the apparatus for the present invention.

FIG. 6 shows another embodiment of the compressor. The compressor shown in FIG. 6 has lubricant oil pump 51 as well as an oil pump 50 so that the compressor shown in FIG. 6 can be lubricated more effectively.

Figure 7:
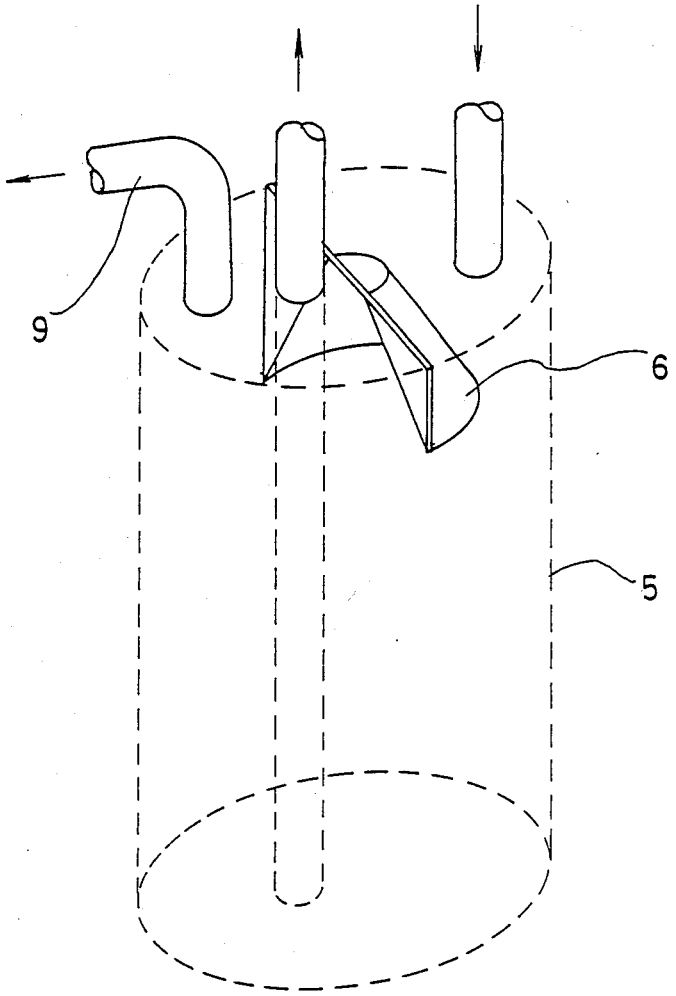
FIG. 7 is a perspective view of the gas-liquid separator used for the apparatus of the present invention.

FIG. 7 shows another embodiment of the gas-liquid separator 5. The gas-liquid separator of FIG. 7 has a separating plate 6 into which the coolant from the condenser 3 collides.

Figure 8:
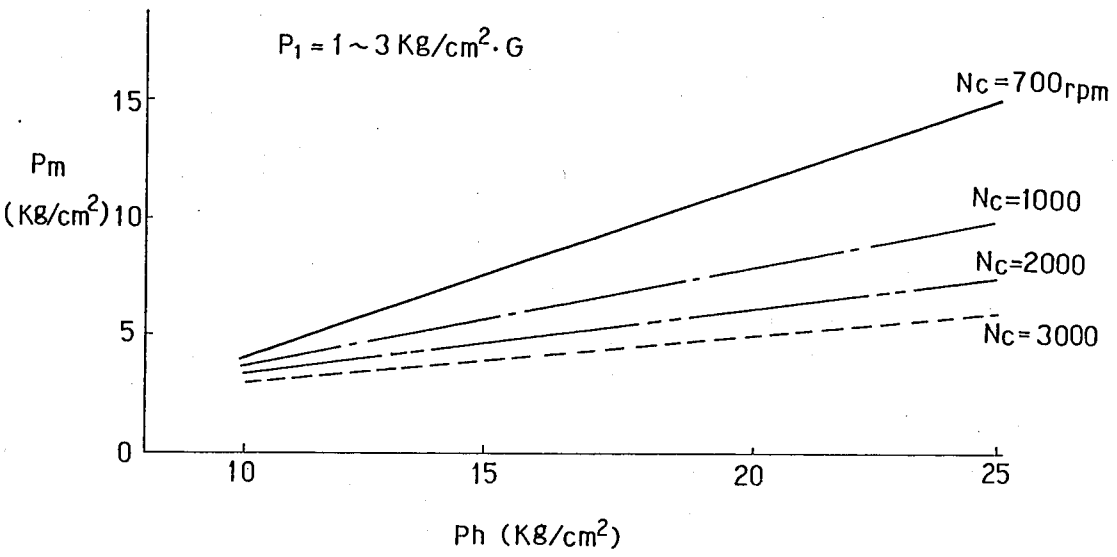
FIG. 8 is a diagram showing the relationship between discharge pressure and suction pressure of the compressor used for the apparatus of the present invention.
Figure 9:
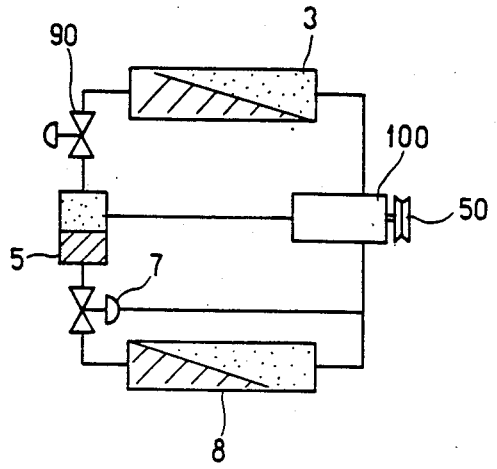
FIG. 9 shows a second embodiment of the refrigerant apparatus of the present invention.
Figure 10:
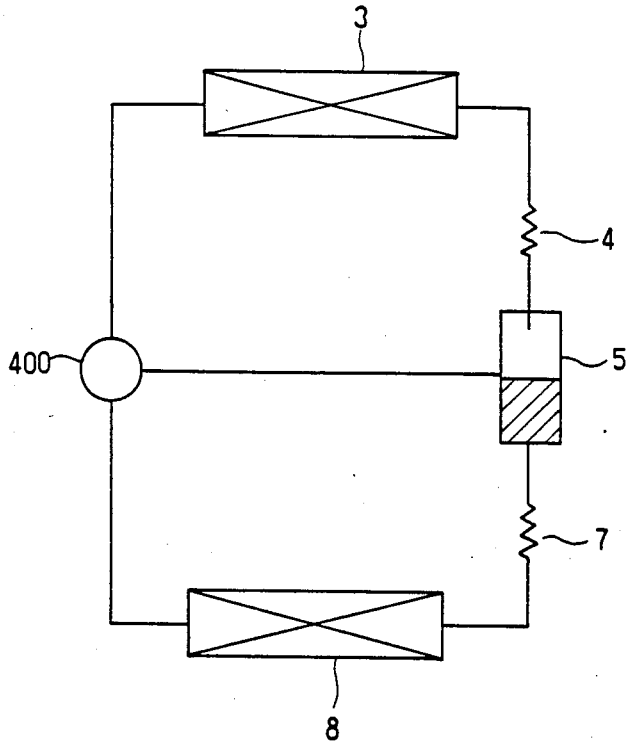
FIG. 10 shows a conventional type refrigerant apparatus.
Figure 11:
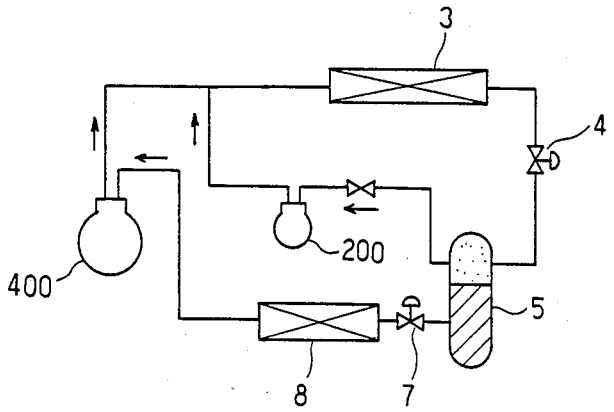
FIG. 11 shows another type of conventional refrigerant apparatus.

FIG. 9 shows another embodiment of the present invention having a variable choke means 90 as the first expansion valve means. The variable choke means 90 can vary the effective opening area of the conduit downstream of the condenser 3 in order to maintain the pressure downstream of the variable choke means 9 at a predetermined pressure. The apparatus shown in FIG. 9 has a special advantage in that the pressure reference between the pressure of the coolant in the gas-liquid separator 5 and that in the evaporator 8 can be maintained within a predetermined range. Since the discharge pressure from the compressor 100 can be varied in accordance with the condition of the refrigerant apparatus, the pressure within the gas-liquid separator should be varied in response to the discharge pressure if the capillary tube is used as the first expansion valve means 4 as shown in FIG. 8. Namely, the pressure of the coolant within the gas liquid separator is increased more than 10 kg/cm$^2$·G when the discharge pressure of the compressor is increased more than about 18 kg/cm$^2$·G and when the rotation of the compressor NC is 700 RPM. It should be noted that the suction pressure from the evaporator 8 is maintained about 2 kg/cm$^2$·G in order to work the evaporator 8 even though the pressure within the gas-liquid separator 5 is increased. Therefore, a serious pressure difference should be produced between the suction chamber connected with the evaporator 8 and the suction chamber 28 connected with the gas-liquid separator 5 when the pressure within the gas-liquid separator 5 is increased. Such a pressure difference should cause the rotation of the compressor 100 to be irregular.

The apparatus shown in FIG. 9, however, does not have such problem. Since the pressure of the coolant within the gas-liquid separator 5 is always maintained at the predetermined pressure value by the variable choke means 90, and since the pressure downstream of the evaporator 8 is also maintained at the predetermined pressure value by the second expansion valve means 7, the pressure difference between the suction chamber 28 which is connected with the gas-liquid separator 5 and the suction chamber 27 which is connected with the evaporator 8 can be maintained within a predetermined range. Therefore, the compressor 100 can rotate smoothly.

Though a compressor 100 having ten cylinders is described in the above embodiment, another compressor which has six cylinders, for example, can also be used as the compressor 100 of the present invention. Any other types of compressor having a plurality of cylinders and a plurality of pistons provided within the cylinders and a single shaft which reciprocates the pistons also may be used as the compressor of the present invention.

What is claimed is:

1. A refrigerant apparatus, comprising:

a compressor having a plurality of cylinders, a plurality of pistons provided within said cylinders in such a manner that said pistons reciprocate within said cylinders, a single drive shaft functionally connected with each of said pistons so that said pistons reciprocate within said cylinders, a plurality of discharge chambers connected to said cylinders, and a plurality of suction chambers connected to said cylinders, said compressor sucking, compressing and discharging coolant;

a condenser connected to all of said plurality of discharge chambers of said compressor so that the coolant discharged from said compressor to said condenser is condensed;

a first expansion valve means connected to said condenser for reducing the pressure of the coolant downstream from said condenser;

a gas-liquid separator connected to said first expansion valve means so that the coolant introduced into said gas-liquid separator from said first expansion valve means is separated into its gas phase and liquid phase, at least one of said plurality of suction chambers of said compressor being connected to an output which outputs the gas phase;

a second expansion valve means connected to an output of said gas-liquid separator outputting the gas phase of said coolant for reducing the pressure of the coolant passing therethrough; and an evaporator connected to an output of said second expansion valve means so that the coolant passing through said evaporator is evaporated, the plurality of suction chambers other than said at least one suction chamber being connected to an output of said evaporator.

2. A refrigerant apparatus according to claim 1, wherein said compressor has a wobble plate connected to said shaft, said pistons being connected to said wobble plate so that the rotation of said wobble plate makes said pistons reciprocate.

3. A refrigerant apparatus according to claim 1, wherein said first expansion valve means is a capillary tube.

4. A refrigerant apparatus according to claim 1, wherein said first expansion valve means is a variable choke means which varies an effective opening area of a conduit through which the coolant passes in order to maintain the pressure downstream of said variable choke means at a predetermined pressure.

* * * * *

United States Patent [19]

Elsener

[11] Patent Number: 4,742,695

[45] Date of Patent: May 10, 1988

[54] BROOCH

[76] Inventor: Carl Elsener, Uetlibergstrasse 60, CH-8902 Urdorf, Switzerland

[21] Appl. No.: 824,185

[22] Filed: Jan. 30, 1986

[30] Foreign Application Priority Data

Feb. 14, 1985 [CH] Switzerland ..... 676/85

[51] Int. Cl.[4] ..... A44C 1/00; A44C 15/00

[52] U.S. Cl. ..... 63/1.1; 63/20; 24/160

[58] Field of Search ..... 24/157, 160; 63/20, 63/12; 40/1.5

[56] References Cited

U.S. PATENT DOCUMENTS

| | | | |
|---|---|---|---|
| 87,072 | 2/1869 | Rowland | 63/20 |
| 594,532 | 11/1897 | Hatten | 24/160 |
| 3,524,230 | 8/1970 | Hankel | 24/157 R |

FOREIGN PATENT DOCUMENTS

| | | | |
|---|---|---|---|
| 32958 | 5/1908 | Austria | 24/160 |
| 62673 | 12/1913 | Austria | 24/157 R |
| 3028470 | 3/1982 | Fed. Rep. of Germany . | |
| 3434475 | 11/1985 | Fed. Rep. of Germany | 63/12 |

*Primary Examiner*—Richard J. Johnson

*Attorney, Agent, or Firm*—Thomas W. Speckman; Ann W. Speckman

[57] ABSTRACT

A brooch comprising two parts (1, 2) is provided with a hinge (4) and a hinge pin (3). Pocket-like cavities (5, 6) are provided in the brooch parts (1, 2) diametrically opposite the hinge (4). A spring pin (7) is soldered in one of the pockets (5) which locks positively in the pocket in the other part of the brooch when it is closed. A pin (10) is affixed to one part of the brooch and extends across the brooch from an area remote from the hinge to an area adjacent the hinge on the other part of the brooch (2) where an eye (11) is provided. As the two parts (1, 2) of the brooch are swung open or shut, the tip of the pin (10) moves into or out of the eye (11). A notch (12) is provided at the joint between the two parts of the brooch (1, 2). The fastener according to the present invention is particularly compact, hardly increases the thickness of the piece of jewelry concerned and makes possible the creation of a number of new designs of jewelry.

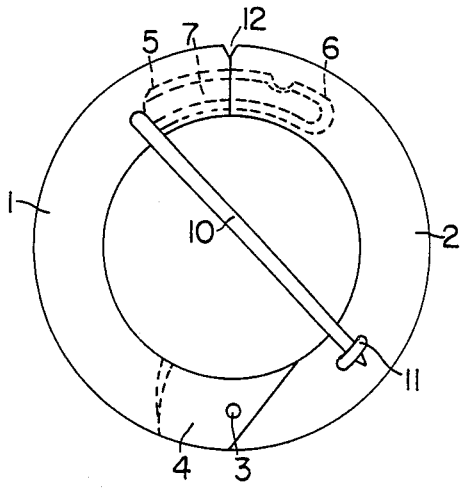

5 Claims, 3 Drawing Sheets